US011284716B2

(12) United States Patent
Chang

(10) Patent No.: US 11,284,716 B2
(45) Date of Patent: Mar. 29, 2022

(54) READING STAND

(71) Applicant: Jui-Chen Chang, Taipei (TW)

(72) Inventor: Jui-Chen Chang, Taipei (TW)

( * ) Notice: Subject to any disclaimer, the term of this patent is extended or adjusted under 35 U.S.C. 154(b) by 0 days.

(21) Appl. No.: 16/355,815

(22) Filed: Mar. 17, 2019

(65) Prior Publication Data

US 2020/0288861 A1 Sep. 17, 2020

(51) Int. Cl.
*A47B 23/04* (2006.01)

(52) U.S. Cl.
CPC .... *A47B 23/043* (2013.01); *A47B 2220/0016* (2013.01)

(58) Field of Classification Search
CPC ..... A47B 23/043; A47B 23/042; A47B 2220/0016; A47B 2023/049; A47B 2220/0019; A47F 7/0042; B42F 17/00; B42F 17/26; F16M 2200/08; F16M 11/22
USPC ..... 248/454–457, 688, 152, 558, 460, 174; 40/400, 403, 388, 376, 389, 404, 505; 211/43, 47–48, 169
See application file for complete search history.

(56) References Cited

U.S. PATENT DOCUMENTS 456,089 A * 7/1891 Harrison ..... A47B 23/042 248/452
531,556 A * 12/1894 Orth ..... B42D 17/00 281/43
914,469 A * 3/1909 Weaver ..... A47F 7/16 211/48
941,084 A * 11/1909 Marsh ..... B42F 17/18 40/400
1,272,094 A * 7/1918 Rand ..... B42F 17/18 40/400
1,513,027 A * 10/1924 Belli ..... B42F 17/00 40/374
1,587,299 A * 6/1926 Grossman ..... A47B 19/04 40/389
1,885,929 A * 11/1932 Lloyd ..... B42F 17/18 40/392
2,326,241 A * 8/1943 Martin ..... B42F 17/00 40/403
3,302,318 A * 2/1967 Lewis ..... B42F 17/28 40/403
3,391,796 A * 7/1968 Cross ..... G09F 15/0087 211/169
3,791,651 A * 2/1974 Barnum ..... A63F 1/10 273/150
D244,331 S * 5/1977 Woods ..... D18/12
4,066,168 A * 1/1978 O'Toole ..... B42D 17/00 211/4

(Continued)

*Primary Examiner* — Ingrid M Weinhold

(57) ABSTRACT

A reading stand contains: a body and a support pedestal. The body includes an accommodation space, a peripheral frame, multiple orifices, two central hanging orifices, a reinforcement rib, two opposite second recesses, and four shock absorbers arranged on four corners of an outer periphery of the peripheral frame respectively. The stand is hollow and is formed in a rectangle shape. The support pedestal includes two extensions arranged on two opposite long sides thereof respectively, and the support pedestal includes two non-slip parts covered on the two extensions individually. One of the two extensions of the support pedestal is engaged with the two opposite first recesses or the two opposite second recesses so as to change a readable angle of the body.

3 Claims, 10 Drawing Sheets

(56) References Cited

U.S. PATENT DOCUMENTS 4,426,007 A * 1/1984 Beleckis ..... B42F 5/005 211/169
4,624,433 A * 11/1986 Henneberg ..... F16M 11/10 248/346.06
5,141,196 A * 8/1992 Arnold ..... F16M 11/10 248/126
5,451,025 A * 9/1995 Hames ..... A47B 23/043 248/452
5,746,410 A * 5/1998 Hung ..... B41J 29/15 248/441.1
6,113,052 A * 9/2000 Gentile ..... A47B 23/043 108/9
6,394,291 B2 * 5/2002 Maier-Hunke ..... G09F 15/0087 211/169
6,435,466 B1 * 8/2002 Adams ..... A47B 23/044 248/455
6,505,797 B1 * 1/2003 Dempsey ..... F16M 13/00 248/166
6,678,978 B2 * 1/2004 Maier-Hunke ..... G09F 15/0087 40/376
6,776,385 B1 * 8/2004 Chang ..... A47B 23/043 248/448
D498,087 S * 11/2004 Stein ..... D6/679
6,825,415 B1 * 11/2004 Chen ..... F16M 11/10 174/50
6,826,858 B1 * 12/2004 Muller ..... A47G 1/17 211/169
6,918,565 B2 * 7/2005 Chang ..... A47B 23/043 211/169
6,971,622 B2 * 12/2005 Ziegler ..... F16M 11/10 248/454
7,758,009 B1 * 7/2010 Chang ..... A47B 23/044 248/453
7,770,864 B2 * 8/2010 Phifer ..... A47B 23/043 248/453
8,038,116 B2 * 10/2011 Lee ..... A47B 23/043 248/454
8,579,246 B2 * 11/2013 Chang ..... A47B 23/043 248/292.12
9,364,081 B1 * 6/2016 Haymond ..... A47B 23/044
9,423,067 B2 * 8/2016 Sun ..... A47B 23/044
9,550,292 B1 * 1/2017 Putila ..... B25H 3/04
9,813,533 B1 * 11/2017 Ye ..... H04M 1/04
2002/0014466 A1 * 2/2002 Maier-Hunke ..... G09F 15/0087 211/169
2006/0186303 A1 * 8/2006 Phifer ..... A47B 23/043 248/454
2010/0090085 A1 * 4/2010 Corrion ..... F16M 11/38 248/459
2013/0181106 A1 * 7/2013 Lin ..... F16M 13/00 248/463
2013/0214114 A1 * 8/2013 Gruber ..... F16M 11/22 248/463
2019/0298057 A1 * 10/2019 Xiao ..... F16B 5/00

* cited by examiner

READING STAND

FIELD OF THE INVENTION

The present invention relates to a reading stand which is capable of adjusting a readable angle of the body based on using requirements.

BACKGROUND OF THE INVENTION

A conventional reading stand contains a body and a support pedestal, wherein the support pedestal has a metal block and its top is connected with the body.

However, the conventional reading stand has defects as follows:

The conventional reading stand cannot adjust a readable angle based on using requirements.

The body cannot engage with multiple bodies to increasing readable range of the reading stand.

The present invention has arisen to mitigate and/or obviate the afore-described disadvantages.

SUMMARY OF THE INVENTION

The primary aspect of the present invention is to provide a reading stand which is capable of adjusting a readable angle of the body based on using requirements.

To obtain the above-mentioned aspect, a reading stand provided by the present invention contains: a body and a support pedestal.

The body includes an accommodation space defined in the body, a peripheral frame formed around an inner periphery of the body, multiple orifices defined on a top and a bottom of an inner periphery of the peripheral frame respectively, two central hanging orifices arranged proximate to the multiple orifices of the peripheral frame individually, a reinforcement rib formed on two sides of the inner periphery of the peripheral frame, two opposite first recesses defined on two sides of the reinforcement rib, two opposite second recesses formed above the two opposite first recesses individually, and four shock absorbers arranged on four corners of an outer periphery of the peripheral frame respectively.

The stand is hollow and is formed in a rectangle shape, the support pedestal includes two extensions arranged on two opposite long sides thereof respectively, and the support pedestal includes two non-slip parts covered on the two extensions individually.

Preferably, one of the two extensions of the support pedestal is engaged with the two opposite first recesses or the two opposite second recesses so as to change a readable angle of the body.

DETAILED DESCRIPTION OF THE PREFERRED EMBODIMENTS

Figure 1:
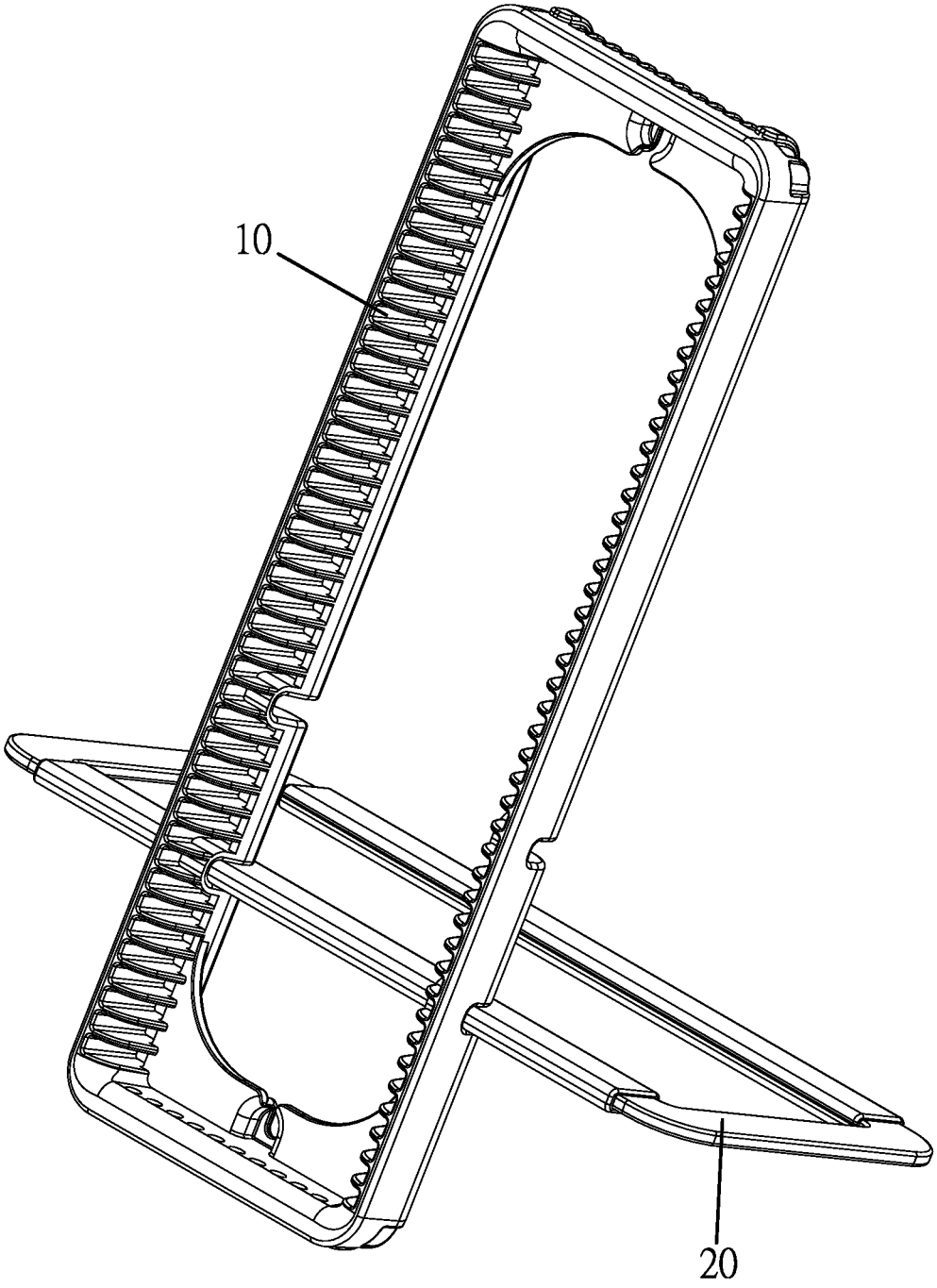
FIG. 1 is a perspective view showing the assembly of a reading stand according to a preferred embodiment of the present invention.
Figure 2:
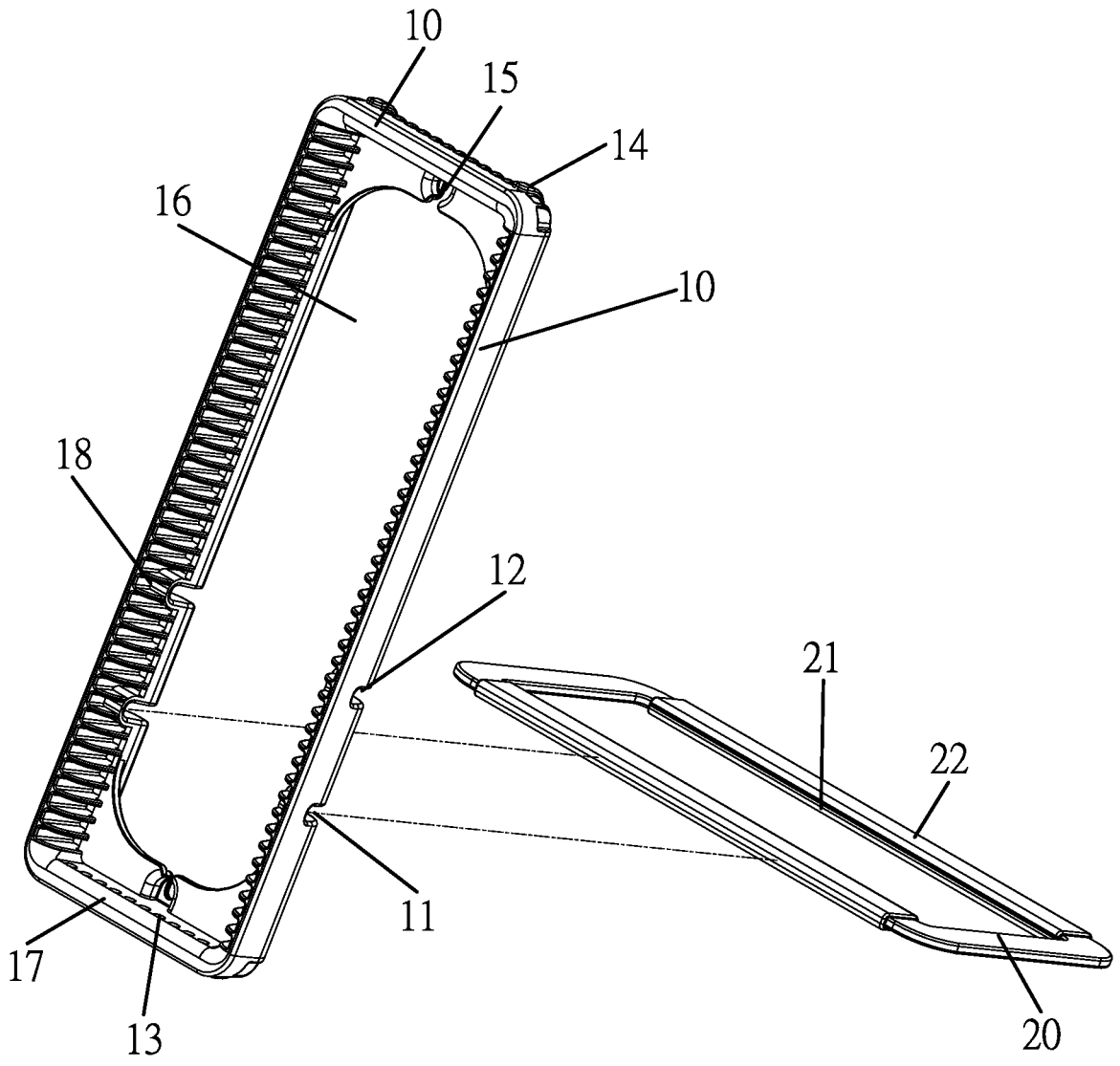
FIG. 2 is a perspective view showing the exploded components of the reading stand according to the preferred embodiment of the present invention.

With reference to FIGS. 1-4, a reading stand according to a preferred embodiment of the present invention comprises: a body 10 and a support pedestal 20.

The body 10 includes an accommodation space 16 defined therein, a peripheral frame 17 formed around an inner periphery of the body 10, multiple orifices 13 defined on a top and a bottom of an inner periphery of the peripheral frame 17 respectively, two central hanging orifices 15 arranged proximate to the multiple orifices 13 of the peripheral frame 17 individually, a reinforcement rib 18 formed on two sides of the inner periphery of the peripheral frame 17, two opposite first recesses 11 defined on two sides of the reinforcement rib 18, two opposite second recesses 12 formed above the two opposite first recesses 11 individually, and four shock absorbers 14 arranged on four corners of an outer periphery of the peripheral frame 17 respectively.

The stand 20 is hollow and is formed in a rectangle shape, the support pedestal 20 includes two extensions 21 arranged on two opposite long sides thereof respectively, and the support pedestal 20 includes two non-slip parts 22 covered on the two extensions 21 individually.

Figure 3:
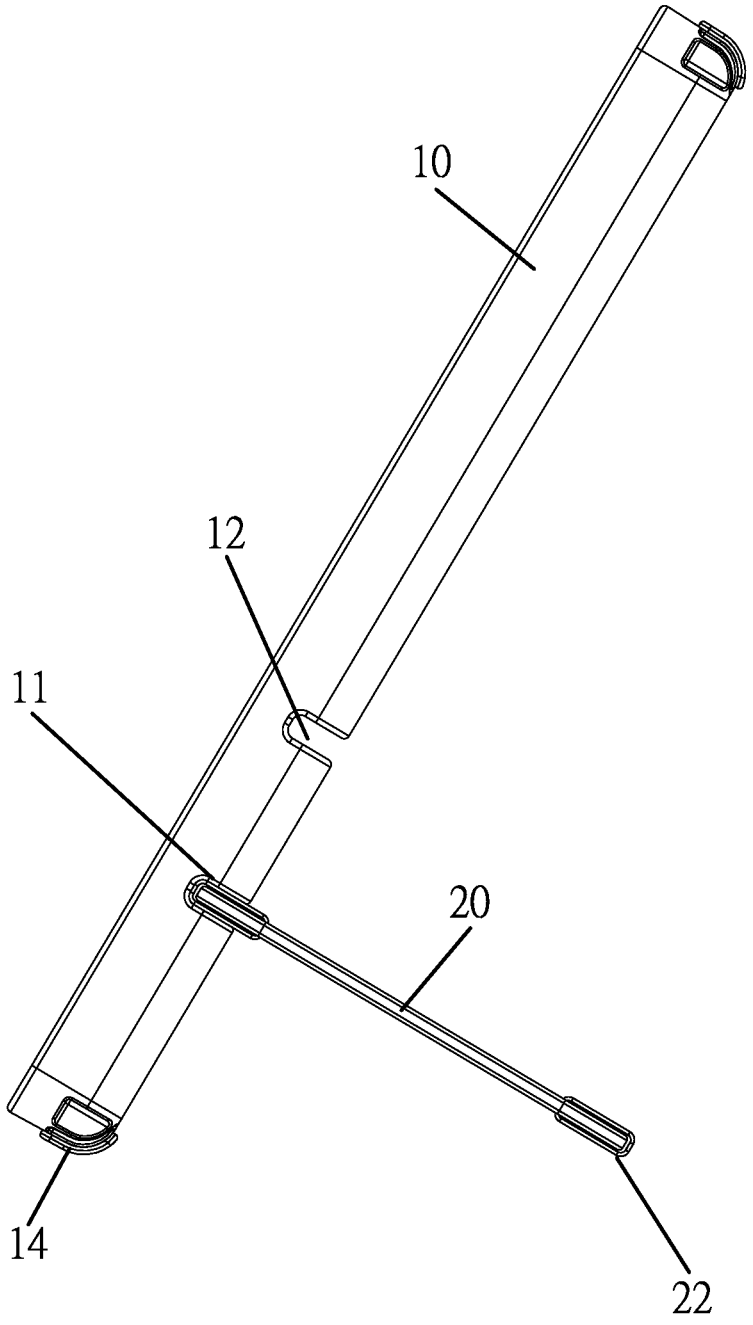
FIG. 3 is a side plan view showing the operation of the reading stand according to the preferred embodiment of the present invention.
Figure 4:
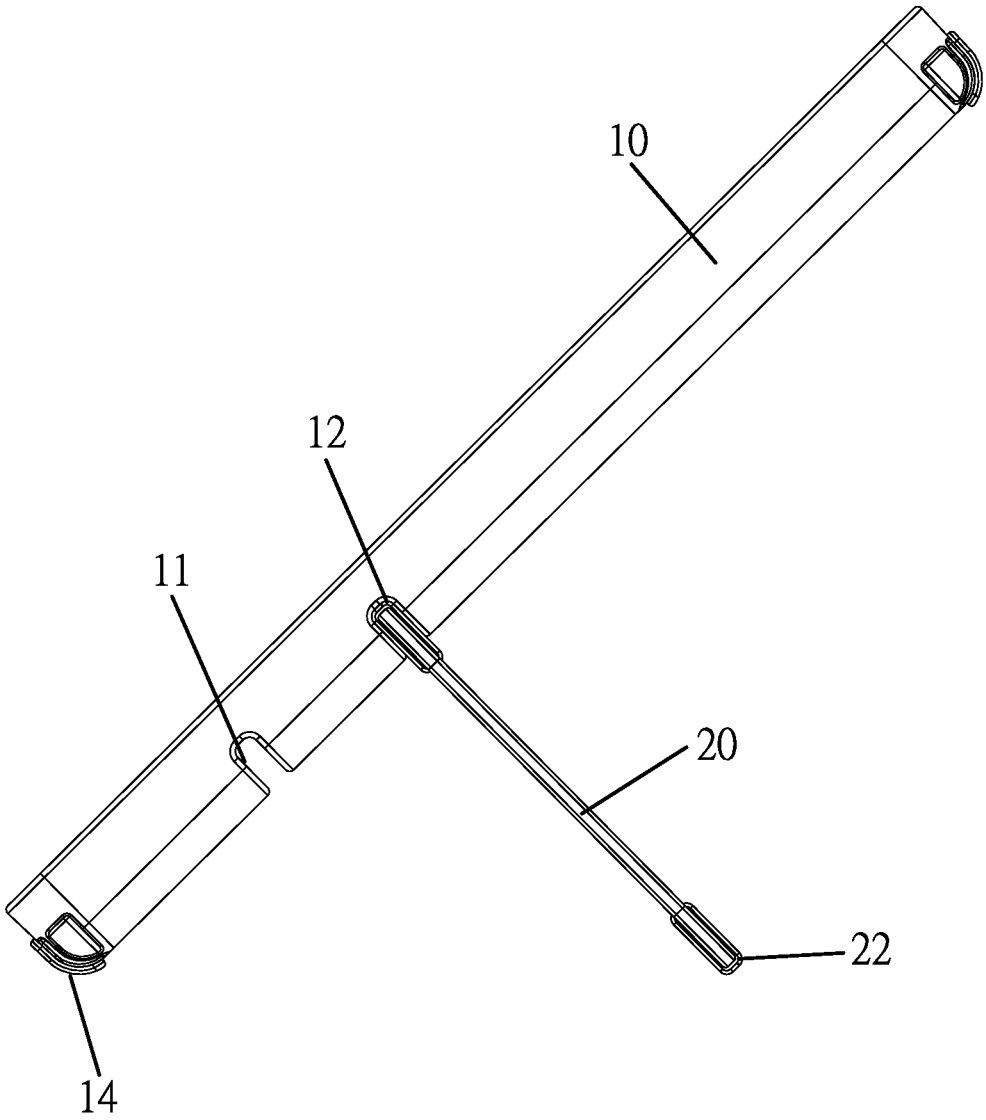
FIG. 4 is another side plan view showing the operation of the reading stand according to the preferred embodiment of the present invention.

Referring to FIGS. 3 and 4, one of the two extensions 21 of the support pedestal 20 is engaged with the two opposite first recesses 11 or the two opposite second recesses 12 so as to change a readable angle of the body 10 (i.e., an angle between the body 10 and the ground), and the two non-slip parts 22 of the support pedestal 20 facilitate positioning of the reading stand.

Figure 5:
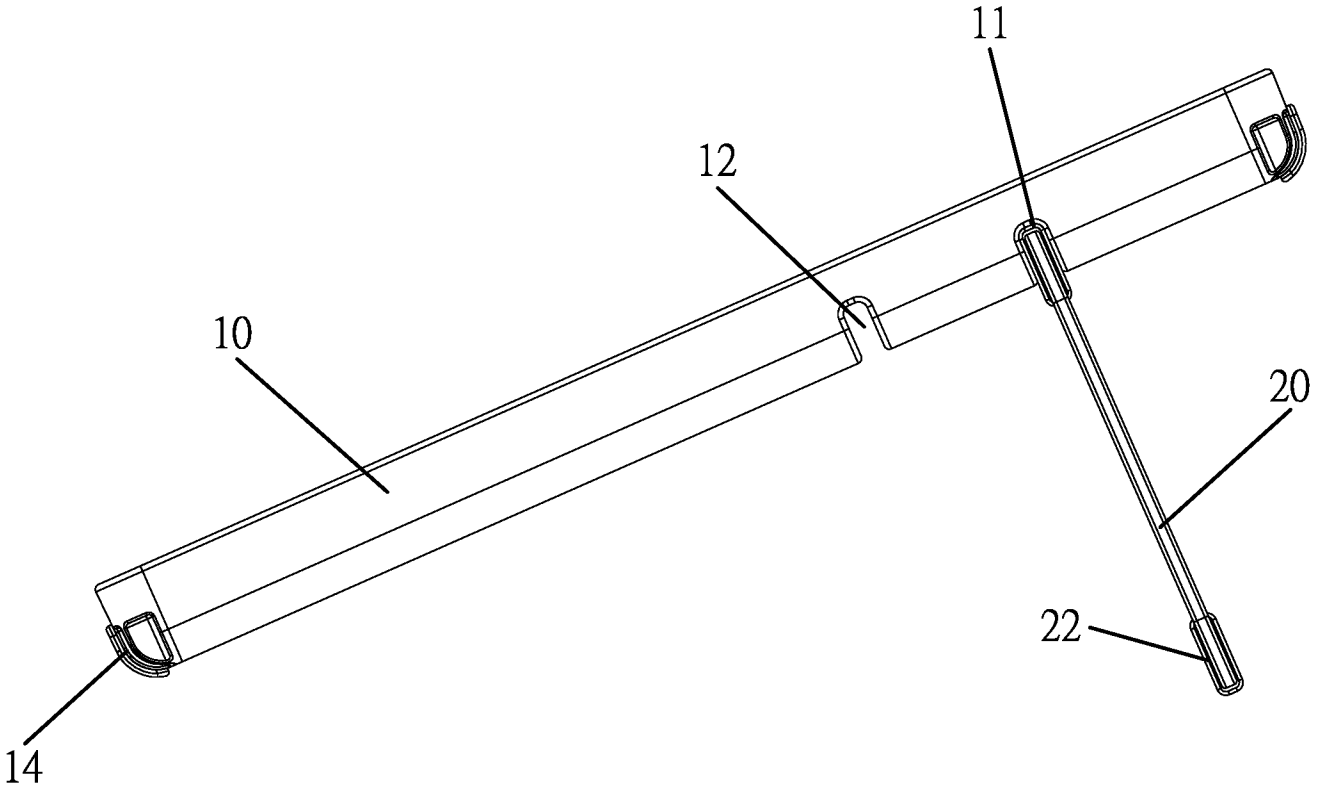
FIG. 5 is also another side plan view showing the operation of the reading stand according to the preferred embodiment of the present invention.

As shown in FIGS. 3-5, after the one extension 21 of the support pedestal 20 is engaged with the two opposite first recesses 11 and the peripheral frame 17 abuts against a ground, the readable angle of the body 10 is 60 degrees. After the one extension 21 of the support pedestal 20 is engaged with the two opposite second recesses 12 and the peripheral frame 17 abuts against the ground, the readable angle of the body 10 is 30 degrees. When one of two opposite short sides of the support pedestal 20 is engaged with the two opposite second recesses 12, the readable angle of the body 10 is 45 degrees. Accordingly, the readable angle of the body 10 is changeable based on using requirements.

Figure 6:
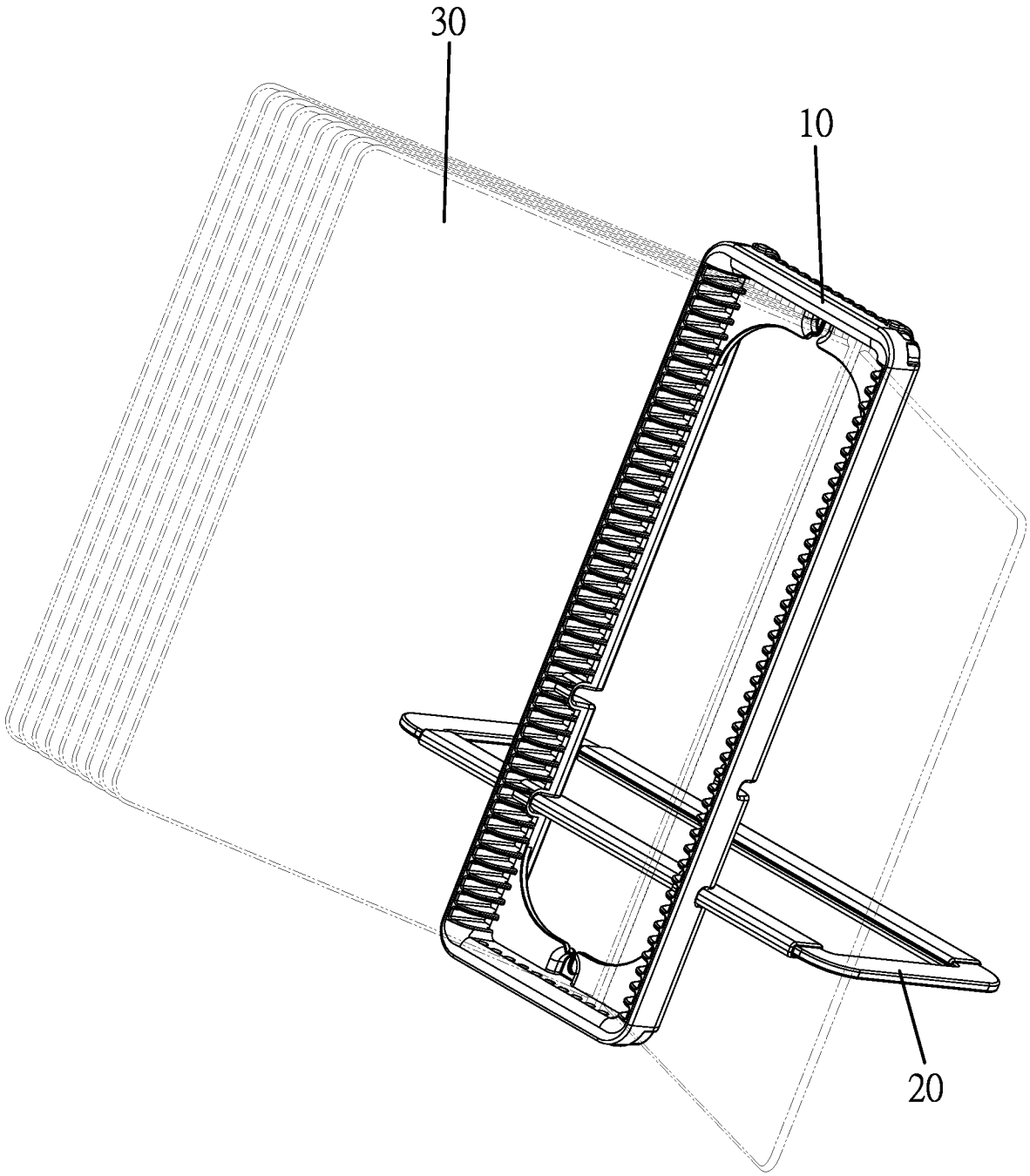
FIG. 6 is a perspective view showing the application of the reading stand according to the preferred embodiment of the present invention.
Figure 7:
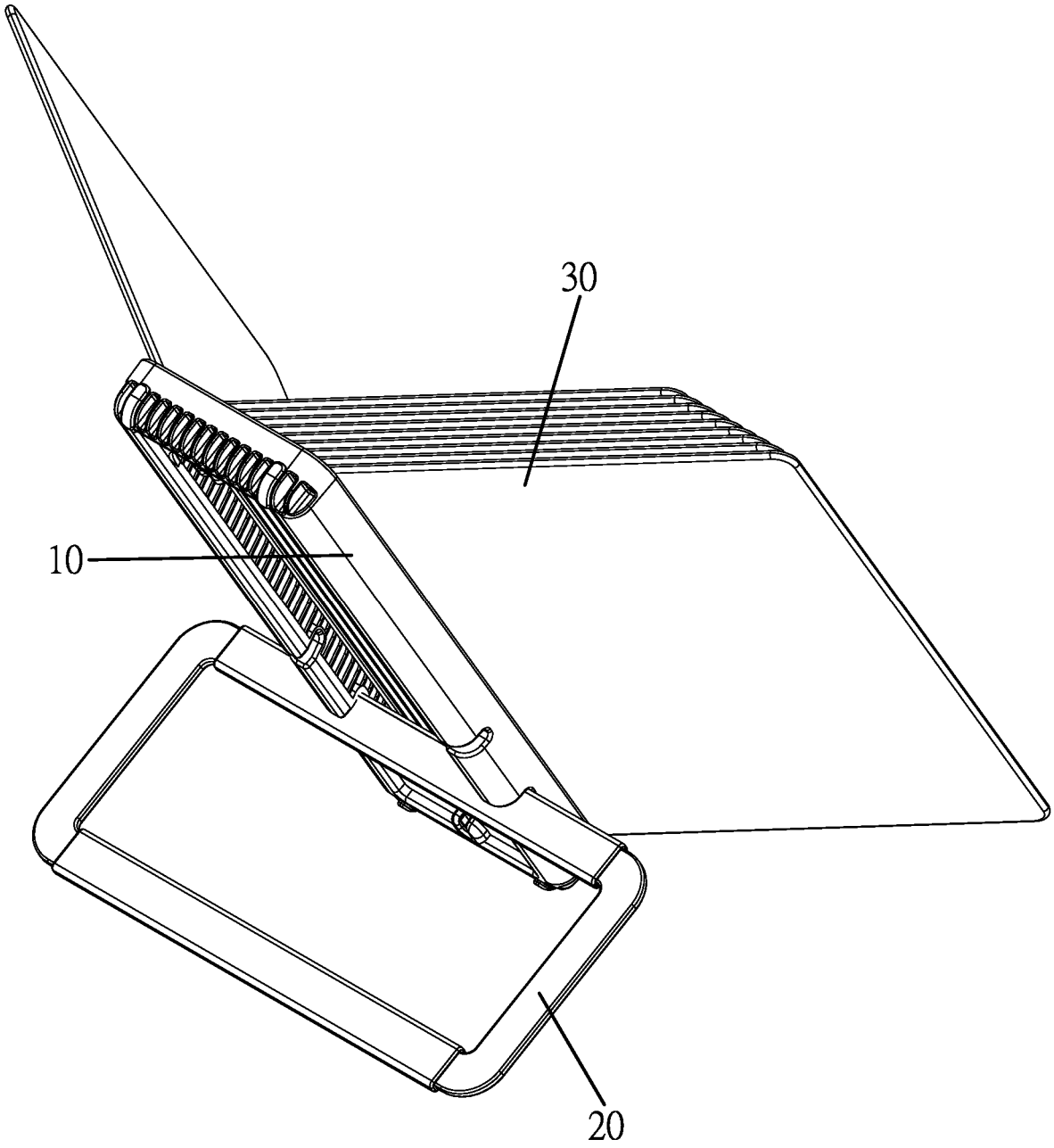
FIG. 7 is another perspective view showing the application of the reading stand according to the preferred embodiment of the present invention.
Figure 8:
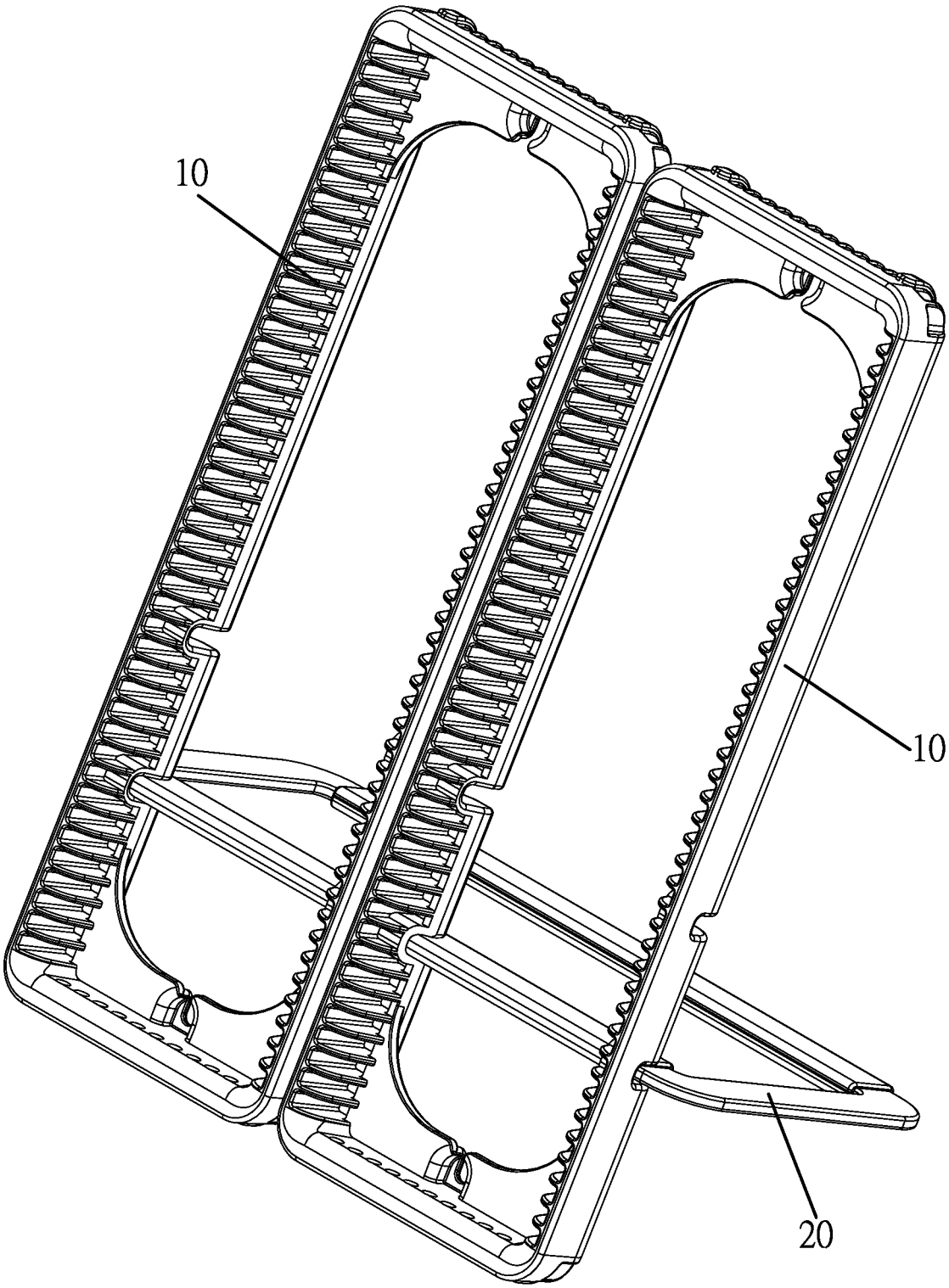
FIG. 8 is also another perspective view showing the application of the reading stand according to the preferred embodiment of the present invention.

As illustrated in FIGS. 6-7, the multiple orifices 13 of the body 10 accommodate multiple folder pages 30. Preferably, the support pedestal 20 is capable of being engaged with at least two bodies 10, thus increasing a number of the at least two bodies 10.

Figure 9:
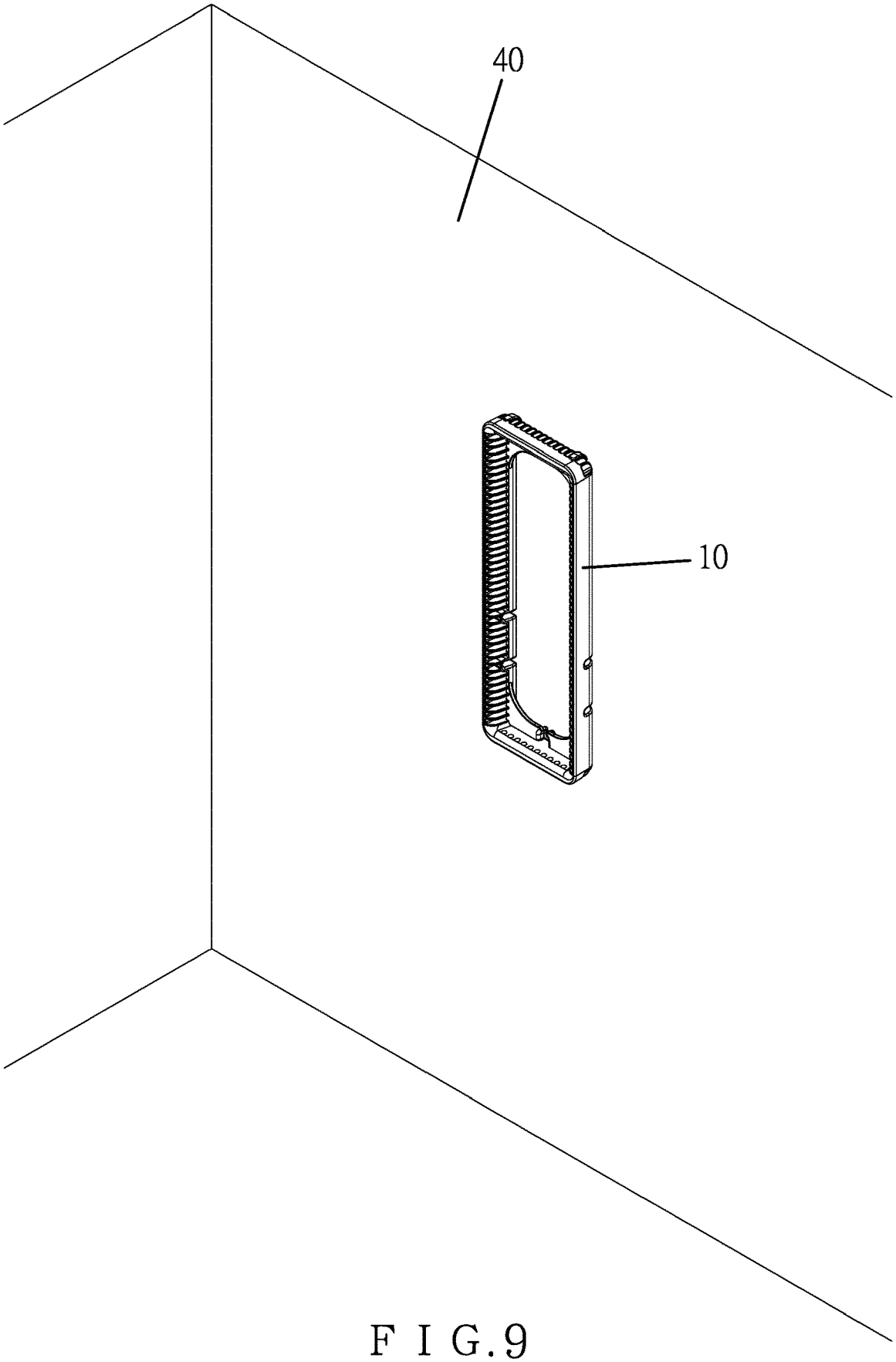
FIG. 9 is still another perspective view showing the application of the reading stand according to the preferred embodiment of the present invention.
Figure 10:
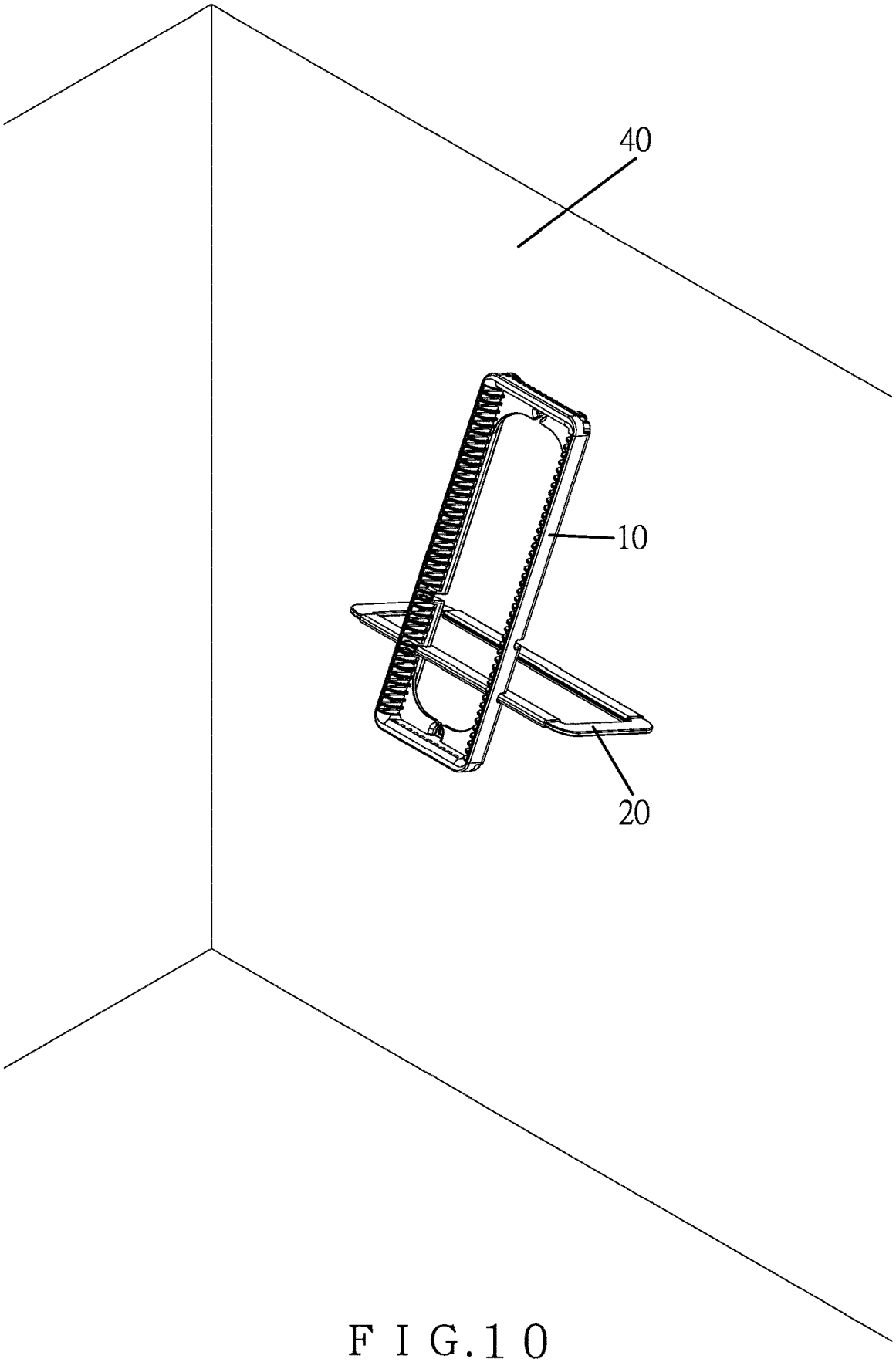
FIG. 10 is another perspective view showing the application of the reading stand according to the preferred embodiment of the present invention.

With reference to FIGS. 9 and 10, the body 10 is hung on a wall 40 by way of the two central hanging orifices 15. Preferably, when the body 10 is hung on the wall 40 by way of the two central hanging orifices 15, it is engaged with the support pedestal 20 so that the support pedestal 20 abuts against the wall, thus adjusting the readable angle of the body 10.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A reading stand comprising: a body and a support pedestal;

the body including: a peripheral frame with two long sides and two short sides; a hollow accommodation space defined in a center of the body; multiple orifices defined on each of the two short sides of the frame; two central hanging orifices formed proximate to the multiple orifices of the two short sides of the frame, respectively; a first reinforcement rib and a second reinforcement rib formed on each of the long sides of the frame, respectively; wherein each of the first reinforcement ribs are substantially coplanar; wherein each of the second reinforcement ribs are spaced from the first reinforcement ribs along respective long sides of the frame, the second reinforcement ribs being substantially coplanar; each of the first reinforcement ribs protruding outwardly from a front surface of the respective long side of the frame and having a first recess extending from a rear surface of the respective long side of the frame; each of the second reinforcement ribs protruding outward from a front surface of the respective long side of the frame and having a second recess extending from a rear surface of the respective long side of the frame; and four shock absorbers arranged on four corners of the body;

the support pedestal comprising two long extensions and two short extensions forming a hollow rectangular shape, and the support pedestal including two non-slip parts covering each of the two long extensions, respectively; the support pedestal configured to support the body.

2. The reading stand as claimed in claim 1, wherein the multiple orifices of the body accommodate multiple folder pages.

3. The reading stand as claimed in claim 1, wherein the support pedestal is capable of being engaged with at least two bodies.

* * * * *